US008174213B2

(12) United States Patent
Gray et al.

(10) Patent No.: US 8,174,213 B2
(45) Date of Patent: May 8, 2012

(54) UNIVERSAL INPUT VOLTAGE LIGHT EMITTING DEVICE

(75) Inventors: Richard Landry Gray, Saratoga, CA (US); Po-Ming Tsai, Taipei (TW)

(73) Assignee: Richard Landry Gray, Saratoga, CA (US)

( * ) Notice: Subject to any disclaimer, the term of this patent is extended or adjusted under 35 U.S.C. 154(b) by 483 days.

(21) Appl. No.: 12/380,044

(22) Filed: Feb. 23, 2009

(65) Prior Publication Data

US 2010/0141179 A1 Jun. 10, 2010

(51) Int. Cl.
*H05B 37/00* (2006.01)

(52) U.S. Cl. ..... 315/312; 315/294; 315/314; 315/318; 362/363; 362/375

(58) Field of Classification Search ..... 315/312, 315/314, 318, 247, 244, 291, 225, 209 R, 315/276, 282, 294; 363/21.01, 21.02, 21.04, 21.11, 21.12, 34, 80, 86, 98, 126; 345/82, 102; 362/31, 29, 26, 362, 363, 375
See application file for complete search history.

(56) References Cited

U.S. PATENT DOCUMENTS

| | | | | |
|---|---|---|---|---|
| 5,661,645 | A * | 8/1997 | Hochstein | 363/89 |
| 7,151,346 | B2 * | 12/2006 | Sanchez | 315/308 |
| 7,183,724 | B2 * | 2/2007 | Ball | 315/274 |
| 7,202,613 | B2 * | 4/2007 | Morgan et al. | 315/312 |
| 7,344,279 | B2 * | 3/2008 | Mueller et al. | 362/294 |
| 7,550,931 | B2 * | 6/2009 | Lys et al. | 315/291 |
| 7,646,029 | B2 * | 1/2010 | Mueller et al. | 257/84 |

* cited by examiner

*Primary Examiner* — Haiss Philogene

(57) ABSTRACT

The configurations of a light emitting device are provided in the present invention. The proposed device includes a light source, an enclosure, and an integrated control circuitry coupled to the light source, enclosed in the enclosure and receiving a universal input voltage.

19 Claims, 3 Drawing Sheets

UNIVERSAL INPUT VOLTAGE LIGHT EMITTING DEVICE

FIELD OF THE INVENTION

The present invention relates to a light emitting device. More particularly, it relates to a light emitting device with a universal input voltage.

BACKGROUND OF THE INVENTION

Voltage standards for residential and industrial lighting vary in magnitude and frequency from one country to the next. Most of the industrialized nations of the world employ AC power for lighting. The most common frequencies vary from 50 Hz in many European countries and China to 60 Hz in North America and Taiwan. Aviation electrical supplies are most commonly 400 Hz.

While the variation of AC line frequency is fairly tight among different countries (50-60 Hz) the variation in line voltage is considerably greater; ranging from 110V in the US to 240V in various European countries and China. Different standards include 100V, 110V, 120V, 208V, 220V and 240V. At this point in time there is no international standard nor is it likely that there will be in the near future because of the huge infrastructure investments in existing electrical power grids in different countries. There is no one "right" answer as to what is the proper voltage. In fact, many people now believe that the decision to use AC power instead of DC power as the norm has turned out to be a less than an ideal decision.

Besides voltage variations between countries there can also be substantial variations within one country and even within one building. In the US one can find 110V, 117V, 120V, up to 277V or even higher, all in one building. For instance, in a US company the office area may be wired with 120V, while the factory area might be wired for 208V. This situation is much more common than one may think at first.

Light emitting devices, more commonly known as light bulbs, whether they are fluorescent, incandescent, white light emitting diode (WLED), cold cathode fluorescent (CCFL), or other types must, by their nature, be designed to run over a voltage range that is much tighter than that found around different countries or even within a single building. If a bulb of any type, designed to run at 110V, was mistakenly used in a fixture wired for 220V the result would be almost certain failure, probably catastrophic and even potentially dangerous. If the lamp did not fail immediately then a slow failure might be even more dangerous since it might not be immediately detected. Instead of immediate failure it could overheat slowly causing a serious fire hazard at a time when no one may be around to notice it and take appropriate action. Safety is arguably the biggest problem associated with improperly matching a lamp to its input line voltage.

A large number of different types of lamps are required to satisfy the lighting needs of so many different supply voltages. The logistics of manufacturing so many different light emitting devices, as well as the complications of transporting and warehousing those light emitting devices increases the costs of those light emitting devices. It may also increase the energy required to produce those devices as well as increase the green house gas emissions (and other unwanted byproducts) that result from the manufacture of those devices.

What is needed is a light emitting device that is tolerant of a wide range of power supply voltages.

Keeping the drawbacks of the prior art in mind, and employing experiments and research persistently, the applicants finally conceived a universal input voltage light emitting device.

SUMMARY OF THE INVENTION

It is therefore an object of the present invention to provide a light emitting device that is tolerant of a wide range of power supply voltages.

According to the first aspect of the present invention, a light emitting device includes a light source, an enclosure, and integrated control circuitry coupled to the light source, partially or wholly enclosed in the enclosure, receiving an input voltage having an input voltage value and an input frequency value, which are respectively in a relatively wide range of voltage value and a relatively wide range of frequency value, and including a pre-regulation stage and a ballasting circuit coupled to the pre-regulation stage.

Preferably, the integrated control circuitry further includes a rectifying stage coupled to the pre-regulation stage, the rectifying stage may be a diode bridge, and the light source is coupled to the ballasting circuit.

Preferably, the pre-regulation stage is one being selected from a group consisting of a boost converter, a buck-boost converter, a flyback converter, a SEPIC, a push-pull converter and a forward converter.

Preferably, the pre-regulation stage provides a power factor correction function and has an output voltage being a relatively high bus voltage. The input voltage range varies from 5V up to 360V, and the pre-regulation stage can provide power factor correction over a relatively wide range of frequency value varies from 0 Hz up to 400 Hz.

Preferably, the lighting device is one selected from a group consisting of a CCFL, an EEFL (external electrode fluorescent lamp) an HCFL (hot cathode fluorescent lamp) and a CNL (carbon nanotube lamp) wherein the ballasting circuit is an inverter and provides a relatively high voltage AC signal to the light source.

Preferably, the lighting device is a WLED, wherein the ballasting circuit includes a constant current control and the light source is driven by a current source.

According to the second aspect of the present invention, a light emitting device includes a light source, an enclosure and an integrated control circuitry coupled to the light source, enclosed in the enclosure and receiving a universal input voltage.

Preferably, the integrated control circuitry includes a rectifying stage, a pre-regulation stage coupled to the rectifying stage and a ballasting circuit coupled to the pre-regulation stage.

Preferably, the rectifying stage is a diode bridge and the integrated control circuitry is totally enclosed in the enclosure.

Preferably, the pre-regulation stage is one being selected from a group consisting of a boost converter, a buck-boost converter, a flyback converter, a SEPIC, a push-pull converter and a forward converter.

Preferably, the pre-regulation stage provides a power factor correction function and has an output voltage being a relatively high bus voltage, and the universal input voltage has an input voltage value in a relatively wide range of voltage value varying from 5V up to 360V and an input frequency value in a relatively wide range of frequency value varying from 0 Hz up to 400 Hz.

Preferably, the device is one selected from a group consisting of a CCFL, an EEFL, an HCFL and a CNL, wherein the ballasting circuit is an inverter and provides a relatively high AC voltage signal to the light source.

Preferably, the device is a WLED, wherein the ballasting circuit includes a constant current control and the light source is driven by a current source.

According to the third aspect of the present invention, a control circuitry includes a rectifying stage receiving an input voltage varying from a first one having a relatively high voltage value and a relatively high frequency value to a second one having a relatively low voltage value and a relatively low frequency value.

Preferably, the control circuitry is configured in a light emitting device, wherein the light emitting device further includes a light source and an enclosure, the control circuitry is an integrated control circuitry coupled to the light source and further includes a pre-regulation stage coupled to the rectifying stage and a ballasting circuit coupled to the pre-regulation stage, all residing in the enclosure.

Preferably, the rectifying stage is a diode bridge and the light source is coupled to the ballasting circuit.

Preferably, the pre-regulation stage is one being selected from a group consisting of a boost converter, a buck-boost converter, a flyback converter, a SEPIC, a push-pull converter and a forward converter.

Preferably, the pre-regulation stage provides a power factor correction function and has an output voltage being a relatively high bus voltage, the relatively wide range of input voltage of the pre-regulation stage varies from 5V up to 360V, and it can provide power factor correction over a relatively wide range of frequency value varying from 0 Hz up to 400 Hz.

Preferably, the light emitting device is one selected from a group consisting of a CCFL, an EEFL, an HCFL, a WLED and a CNL, and the ballasting circuit is an inverter and provides a relatively high voltage AC signal to the light source.

Preferably, the light emitting device is a WLED, the ballasting circuit includes a constant current control and the light source is driven by a current source.

The present invention may best be understood through the following descriptions with reference to the accompanying drawings, in which:

DETAILED DESCRIPTION OF THE PREFERRED EMBODIMENT

By applying the techniques of this patent we envision lighting devices that can run from DC voltages under 12V (e.g., 5V) to AC voltages over 360V and bear a relatively wide range of frequency values from 0 Hz up to 400 Hz. This type of device would be especially useful in the developing world where electrical power may come in many forms.

The price and size of driver electronics for lamp devices continues to drop. This makes it more likely that lamp driver electronics can be cost effectively included within the actual light emitting device. As this becomes the case the included driver electronics can be designed to include a wide input voltage range, essentially making the lighting device "universal" as far as input voltage is concerned.

Figure 1:
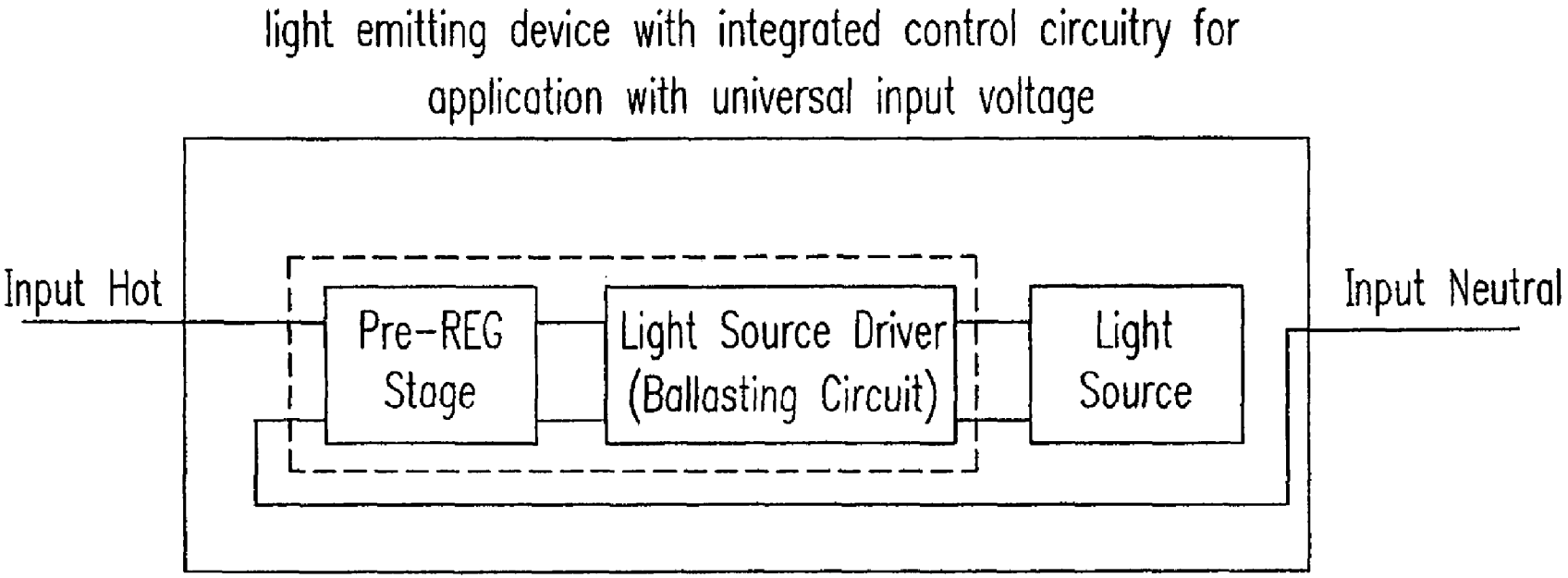
FIG. 1 shows a schematic circuit diagram of a light-emitting device with integrated control circuitry for application with universal input voltage according to the preferred embodiment of the present invention.
Figure 2A:
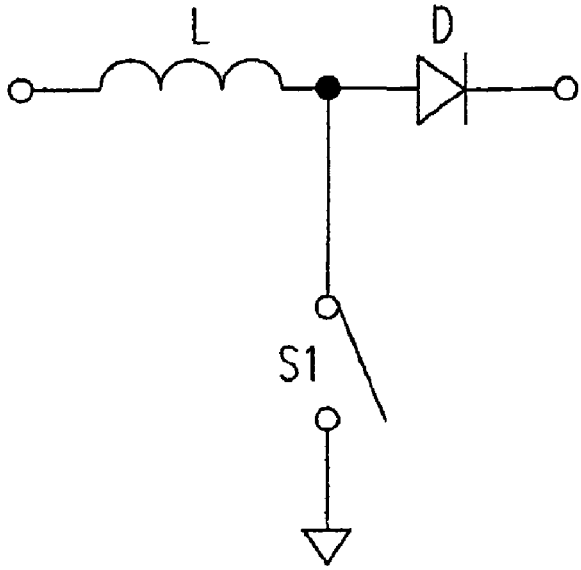
FIGS. 2A-2B show respective circuit diagrams of the pre-regulation stage according to the preferred embodiment of the present invention.
Figure 2B:
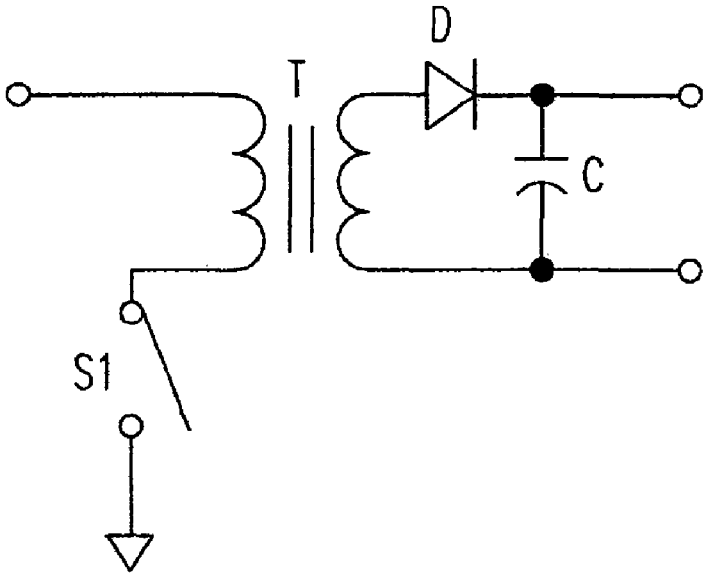

The invention consists of a rectification device at the power supply input such as a diode bridge rectifier or other device that can change AC power into DC power, albeit with some ripple. The next stage is a pre-regulation stage. FIG. 1 shows the general scheme with the rectification stage absorbed into the pre-regulation stage and coupled to an input hot and an input neutral. In FIG. 1, the integrated control circuitry includes the pre-REG stage (the pre-regulation stage) and a light source driver (e.g., a ballasting circuit) coupled to the pre-REG stage. The integrated control circuitry could be either totally enclosed in or partially enclosed within the light emitting device. The light source is coupled to the ballasting circuit. The pre-regulation stage takes the output from the rectifier and provides a high voltage, stable DC bus voltage from 400V to 600V (depending on the particular lighting technology that will be used). The pre-regulation stage might also provide power factor correction (PFC). Common topologies would be a boost converter (including an inductor L, a diode D and a switch S1) or a flyback converter (including a transformer T, a diode D, a capacitor C and a switch S1) as shown in FIGS. 2A and 2B respectively as well as buck-boost, SEPIC, push-pull, and forward converters (not shown). The boost derived topologies, such as the boost, buck-boost, and flyback (an isolated version of buck-boost) converters are particularly well suited for a wide input range since the output voltage to input voltage ratio is a non-linear function of switching duty cycle. Buck derived topologies may also be used however their output voltage to input voltage ratio is usually a linear function of duty cycle which may limit the input voltage range over which they are useful.

Figure 3A:
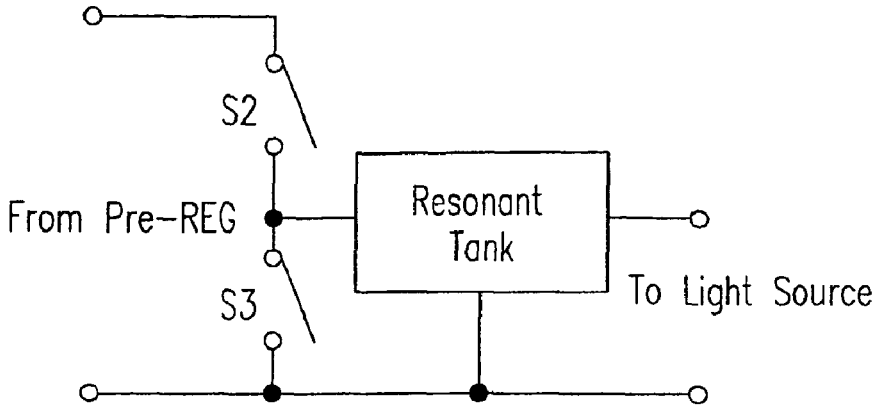
FIGS. 3A-3C show respective schematic circuit diagrams of the ballasting circuit according to the preferred embodiment of the present invention.
Figure 3B:
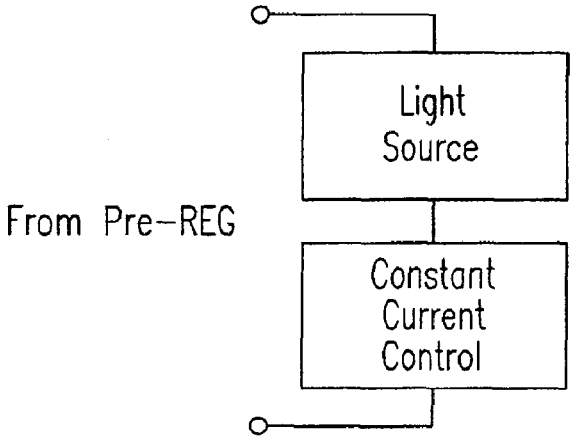
Figure 3C:
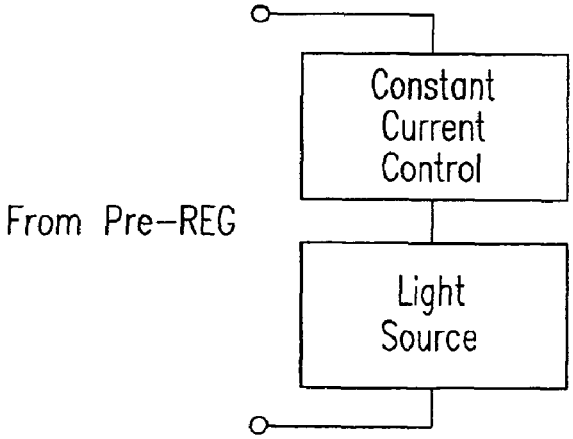

The output of the pre-regulation stage would feed a ballasting circuit that was particular to the type of light emitting device being driven. If the light emitting device were a cold cathode fluorescent tube (CCFL) then the ballasting circuit (including switches S2 and S3, and a resonant tank in FIG. 3A) would provide a high voltage AC signal to the device. The more common hot cathode fluorescent tubes would also require a high voltage AC ballasting circuit. The benefits in both these cases are that the stable DC bus voltage provided by the pre-regulation stage allows the ballasting circuit to be optimized for performance and efficiency. White light emitting diodes (WLED) would be driven with a current source (a constant current control electrically connected to the light source in series) as shown in FIGS. 3B and 3C. As mentioned before, the high bus voltage provided by the pre-regulation stage can be tailored to the particular type of light emitting device in question, improving its efficiency and performance.

Traditional thinking would suggest that adding a pre-regulation stage before a lamp ballast would be too expensive to consider. However the added cost is much less than one might at first expect. The pre-regulated bus voltage allows the magnetic portion (usually the most expensive component) of the ballast to be much smaller, minimizing the impact of the cost of the extra circuitry. The pre-regulated bus also allows for a more sinusoidal current waveform in fluorescent lighting which leads to longer life. If we consider an incremental efficiency improvement coupled with an increase in lifetime it is easy to see that the potential operating costs savings from a pre-regulated light emitting device may more than pay for any cost increase due to additional electronics.

Benefits from the use of light emitting devices with a universal input include:

1. Potentially higher efficiency—fast return on investment due to energy savings;

2. Potential power factor correction—line quality improvement;

3. Stable light output—due to pre-regulation;

4. Easy to open up new markets;

5. Better performance—can tailor the ballast to the light emitting device;

6. Improved safety—both from fire and electrical shock, there is no risk of using the wrong voltage because the device works with all voltages;

7. Easier to stock and transport since "one size fits all"; and

8. Lifetime improvement for fluorescent lamps—pre-regulation allows for sinusoidal current waveform.

According to the aforementioned descriptions, the present invention provides a light emitting device that is tolerant of a wide range of power supply voltages, which indeed possesses the non-obviousness and the novelty.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims, which are to be accorded with the broadest interpretation so as to encompass all such modifications and similar structures. Therefore, the above description and illustration should not be taken as limiting the scope of the present invention which is defined by the appended claims.

What is claimed is:

1. A light emitting device, comprising: a light source; an enclosure; and a control circuitry coupled to the light source, all residing in the same enclosure, receiving an input voltage having an input voltage value and an input frequency value, which are respectively in a relatively wide range of voltage value and a relatively wide range of frequency value, and comprising: a pre-regulation stage; and a ballasting circuit coupled to the pre-regulation stage.

2. A device according to claim 1, wherein the control circuitry further comprises a rectifying stage coupled to the pre-regulation stage, and the light source is coupled to the ballasting circuit.

3. A device according to claim 1, wherein the pre-regulation stage is one being selected from a group consisting of a boost converter, a buck-boost converter, a flyback converter, a SEPIC, a push-pull converter and a forward converter.

4. A device according to claim 1, wherein the pre-regulation stage provides a power factor correction function and has an output voltage being a relatively high bus voltage, the relatively wide range of input voltage value varies from 5V up to 360V, and the relatively wide range of input voltage frequency value varies from 0 Hz up to 400 Hz.

5. A device according to claim 4, wherein the light source is one selected from a group consisting of a CCFL, an EEFL, an HCFL and a CNL, wherein the ballasting circuit is an inverter and provides a relatively high voltage AC signal to the light source.

6. A device according to claim 4, wherein the light source is a WLED, the ballasting circuit comprises a constant current control and the light source is driven by a current source.

7. A light emitting device, comprising: a light source; an enclosure; and a control circuitry coupled to the light source, enclosed in the enclosure and receiving a universal input voltage.

8. A device according to claim 7, wherein the control circuitry comprises a rectifying stage, a pre-regulation stage coupled to the rectifying stage and a ballasting circuit coupled to the pre-regulation stage.

9. A device according to claim 8, wherein the rectifying stage is a diode bridge and the control circuitry is totally enclosed in the enclosure.

10. A device according to claim 8, wherein the pre-regulation stage is one being selected from a group consisting of a boost converter, a buck-boost converter, a flyback converter, a SEPIC, a push-pull converter and a forward converter.

11. A device according to claim 8, wherein the pre-regulation stage provides a power factor correction function and has an output voltage being a relatively high bus voltage, and the universal input voltage has an input voltage value in a relatively wide range of voltage value varying from 5V up to 360V and an input frequency value in a relatively wide range of frequency value varying from 0 Hz up to 400 Hz.

12. A device according to claim 8 being one selected from a group consisting of a CCFL, an EEFL, an HCFL and a CNL, wherein the ballasting circuit is an inverter and provides a relatively high voltage AC signal to the light source.

13. A device according to claim 8 being a WLED, wherein the ballasting circuit comprises a constant current control and the light source is driven by a current source.

14. A control circuitry comprising a rectifying stage receiving an input voltage varying from a first one having a relatively high voltage value and a relatively high frequency value to a second one having a relatively low voltage value and a relatively low frequency value, wherein the control circuitry is configured in a light emitting device, the light emitting device further comprises a light source and an enclosure, the control circuitry is coupled to the light source and being in one of two states being partially enclosed and being wholly enclosed in the enclosure, and further comprises a pre-regulation stage coupled to the rectifying stage and a ballasting circuit coupled to the pre-regulation stage.

15. A control circuitry according to claim 14, wherein the pre-regulation stage provides a power factor correction function and has an output voltage being a relatively high bus voltage, the relatively wide range of voltage value varies from 5V up to 360V, and the relatively wide range of frequency value varies from 0 Hz up to 400 Hz.

16. A control circuitry according to claim 14, wherein the rectifying stage is a diode bridge and the light source is coupled to the ballasting circuit.

17. A control circuitry according to claim 14, wherein the pre-regulation stage is one being selected from a group consisting of a boost converter, a buck-boost converter, a flyback converter, a SEPIC, a push-pull converter and a forward converter.

18. A control circuitry according to claim 15, wherein the light emitting device is a WLED, the ballasting circuit comprises a constant current control and the light source is driven by a current source.

19. A control circuitry according to claim 15, wherein the light emitting device is one selected from a group consisting of a CCFL, an HCFL, and a CNL, and the ballasting circuit is an inverter and provides a relatively high voltage AC signal to the light source.

* * * * *